United States Patent [19]

Klug et al.

[11] 3,977,160

[45] Aug. 31, 1976

[54] MACHINE FOR FILLING CHOCOLATE-BOX TRAYS AND THE LIKE

[75] Inventors: Telesforo Klug, Porto-Ronco; Armin Hofmann, Renens, both of Switzerland

[73] Assignee: SAPAL Societe Anonyme des Plieuses Automatiques, France

[22] Filed: Apr. 24, 1975

[21] Appl. No.: 571,388

[30] Foreign Application Priority Data

July 31, 1974 Switzerland ..... 10528/74

[52] U.S. Cl. ..... 53/240; 221/68; 221/233; 221/278

[51] Int. Cl.[2] ..... B65B 5/12

[58] Field of Search ..... 221/68, 176, 233, 234, 221/211, 252, 278; 53/237, 239, 240

[56] References Cited

UNITED STATES PATENTS

| | | | |
|---|---|---|---|
| 3,130,865 | 4/1964 | Ono et al. | 221/278 X |
| 3,288,331 | 11/1966 | Mazurkivich | 221/68 X |
| 3,357,537 | 12/1967 | Ring | 221/68 X |
| 3,735,556 | 5/1973 | Dille et al. | 53/240 |

FOREIGN PATENTS OR APPLICATIONS

| | | | |
|---|---|---|---|
| 923,009 | 4/1963 | United Kingdom | 221/68 |

*Primary Examiner*—Robert B. Reeves
*Assistant Examiner*—Francis J. Bartuska
*Attorney, Agent, or Firm*—Stevens, Davis, Miller & Mosher

[57] ABSTRACT

A machine for delivering different chocolates or other objects to selected positions on trays comprises, for each type of chocolate, a distribution head receiving chocolates along a waiting line. Yokes of an intermittent chain conveyor laterally displace a number of chocolates to be delivered to a tray, and these chocolates are blown down respective channels leading to the selected positions, where they are taken up by vertically moving suction cups and lowered into the respective position in a tray carried by an intermittently driven conveyor. Synchronized drive of the various members is provided by a directly-linked kinematic chain.

2 Claims, 8 Drawing Figures

P
B
3
A
1
8
4
2
9'
7
27
12
6
28
2
5
2
11
1
P

MACHINE FOR FILLING CHOCOLATE-BOX TRAYS AND THE LIKE

The invention relates to machines for filling container units with different objects, for example chocolate-box trays with wrapped or unwrapped chocolates, in which objects of one type are delivered to an object-distribution head in a column along a waiting line from a loading conveyor belt and from said head to a respective distribution station for the different objects.

Several automatic machines have already been proposed for placing chocolates or other products of different types in selected positions in trays or similar container units. For example, a box of chocolates may include one tray holding 250g of chocolates, or two or three trays respectively with 500 or 750g of chocolates.

In known machines, each distribution station includes suction members which take up a chocolate and deliver it to the desired location in a tray. These suction members are either pivoted by 180° to deliver the chocolates from the input of the distribution station to the tray, or are moved vertically and in translation by a cam and lever system.

An object of the invention is to provide a simplified arrangement which also enables a perfect synchronization between the various parts of the machine.

The invention concerns a machine of the above-mentioned type in which said distribution head comprises members mounted on a chain to successively come to face the column of objects in the waiting line to receive one object each time, means for holding the end of the column when an object has been taken up by a member, a mobile stop to retain said object in the member and separate it from the column, an extractor for removing objects from the members, channels for conveying the extracted objects towards the corresponding distribution station, pneumatic or mechanical means actuated by the extractor to move the objects along said channels up to said distribution station, means for picking-up and lowering the objects into the corresponding container unit, and a conveyor for conveying the container units below the distribution stations, and comprising a directly-linked kinematic chain of members providing synchronised drive of said chain, said holding means, said mobile stop, said extractor, said pick-up means and said container-unit conveyor.

The accompanying drawings show, by way of example, an embodiment of the invention. In the drawings.

Figure 1:
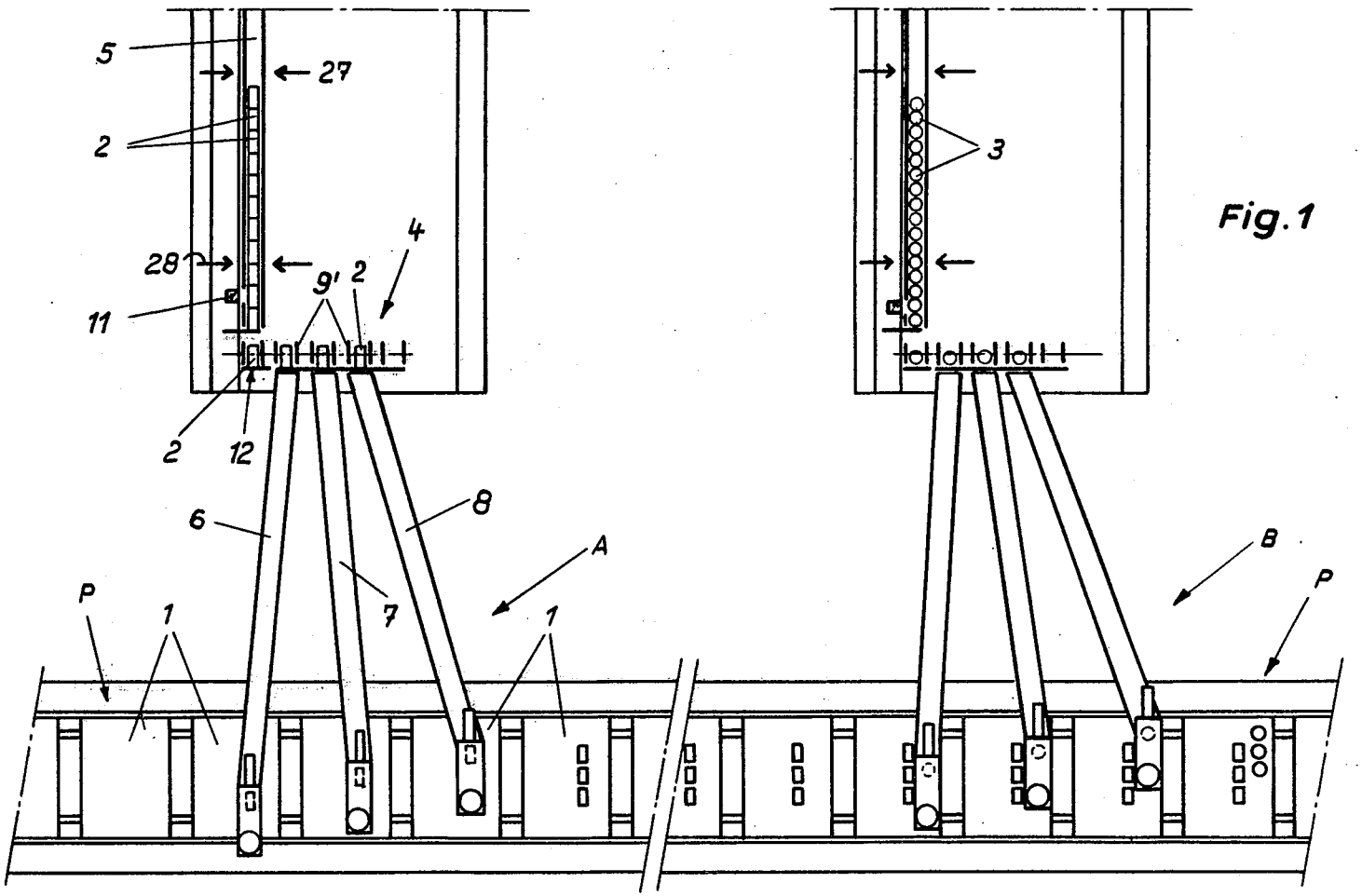
FIG. 1 is a schematic plan view of a machine.
Figure 2:
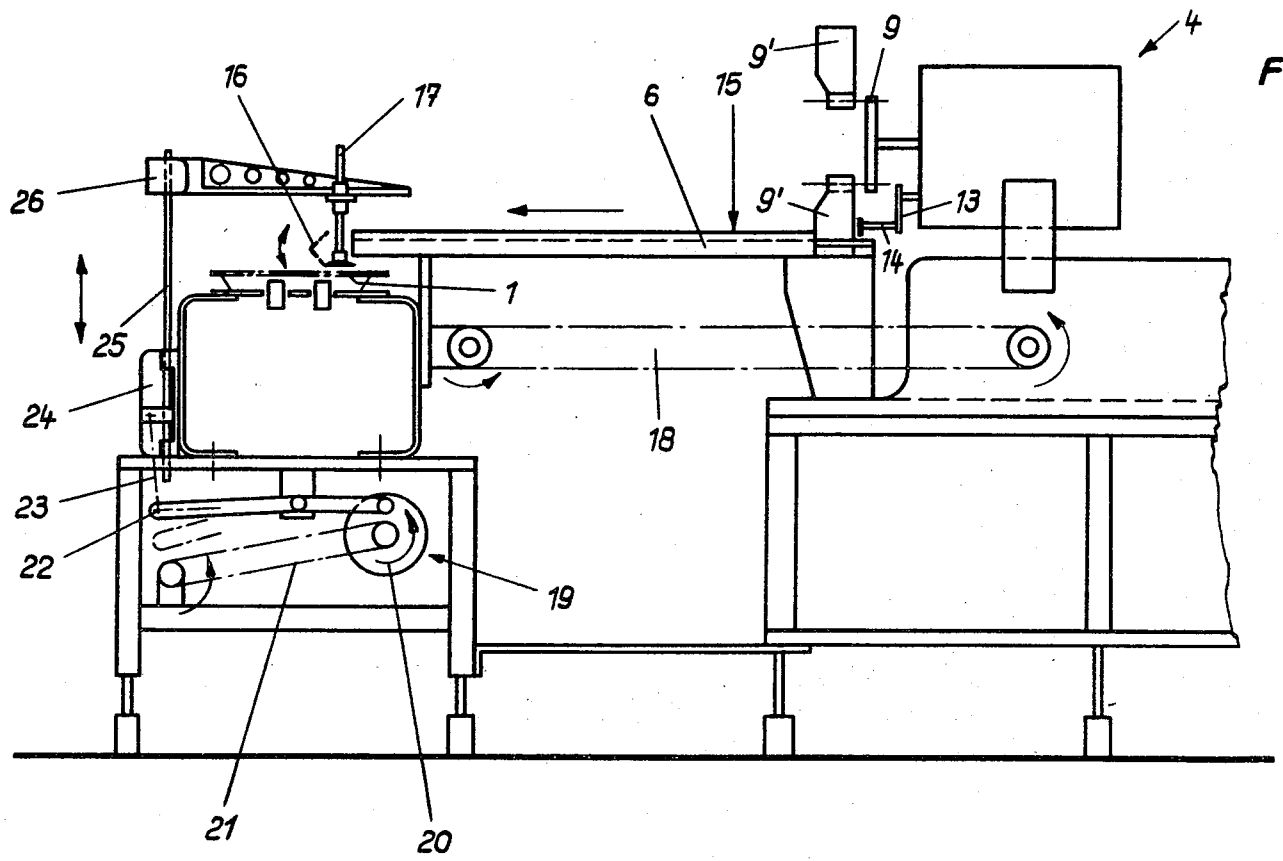
FIG. 2 is a schematic side elevational view of the machine.

The machine shown in FIGS. 1 and 2 serves to fill basic container units or trays 1 of chocolate boxes with chocolates of different types; two types of chocolates are shown in FIG. 1, namely rectangular ones 2 and round ones 3. Instead of chocolates, the installation could of course be used to arrange various other objects.

The trays 1 are disposed on an intermittently driven conveyor P.

The machine shown has two distribution or filling stations A and B, but in fact there will be as many distribution stations as there are different types of chocolates to be arranged in the trays.

For the sake of simplification, the following description of parts of the machine will be limited to the distribution station A.

Chocolates 2 are delivered to a distribution head 4 in a column along a waiting channel or line 5 from a loading belt, not shown.

The distribution head 4 places the successive chocolates 2 from the column into rows each of the number of chocolates of the same type that are to be delivered to chosen locations in a tray 1 passing under station A. In the example shown, head 4 divides the column of chocolates 2 in line 5 into a row of three chocolates to be delivered along channels 6, 7 and 8, as will be described in detail later on.

Figure 5:
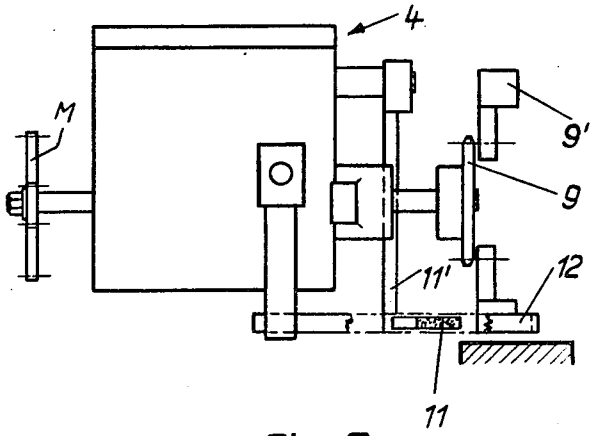
FIGS. 4 and 5 are respectively a plan view and a side elevational view corresponding to FIG. 3.
Figure 3:
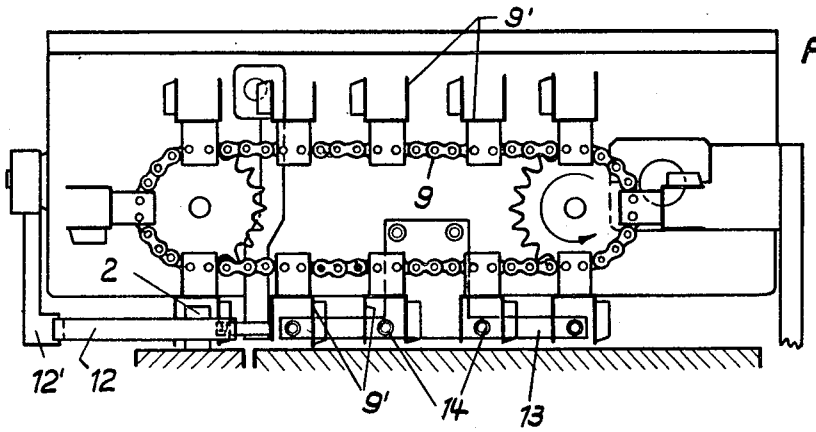
FIG. 3 is a front elevational view of part of the machine.
Figure 4:
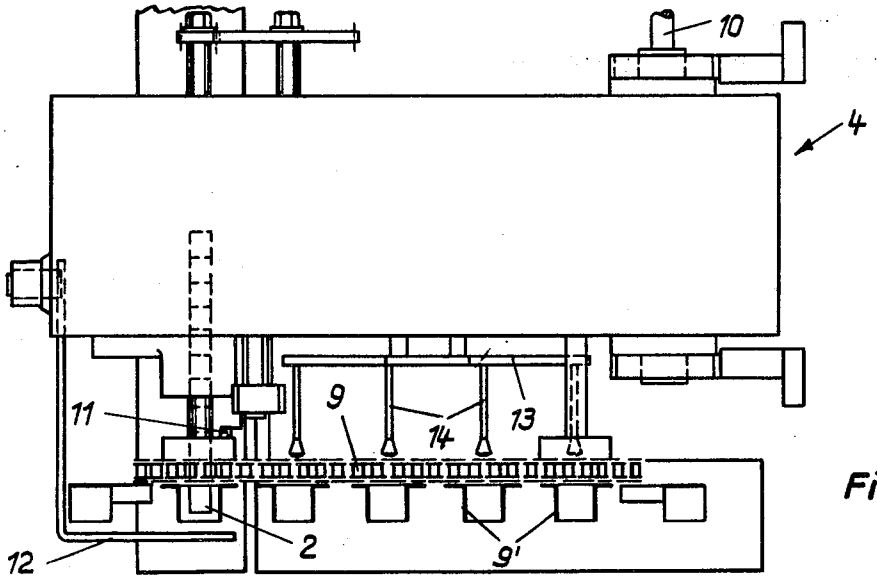
Figure 6:
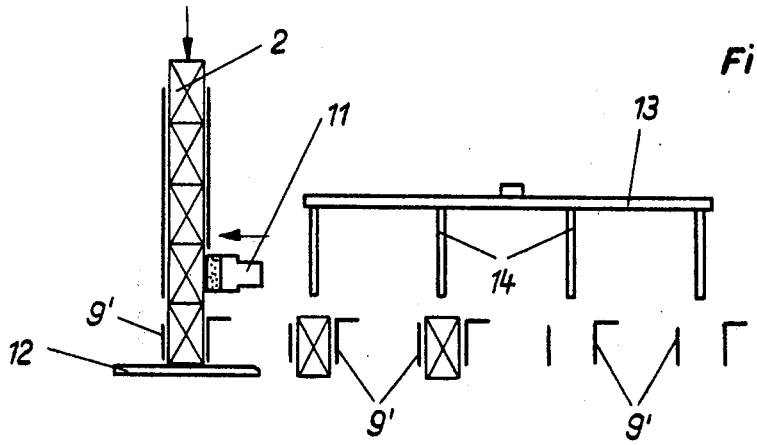
FIGS. 6 to 8 are schematic views illustrating three phases of operation of part of the machine.
Figure 7:
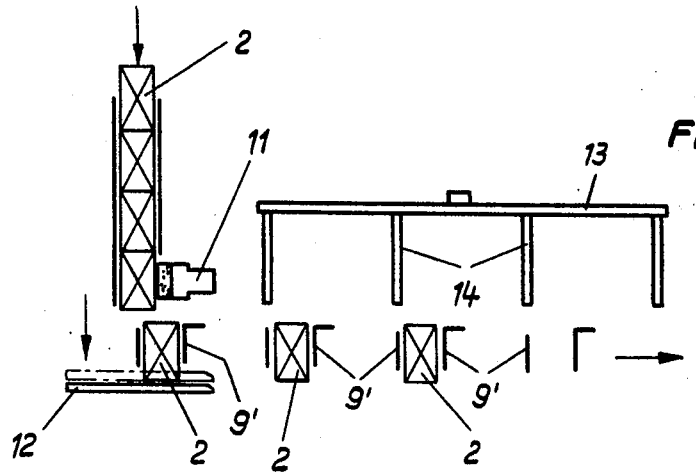
Figure 8:
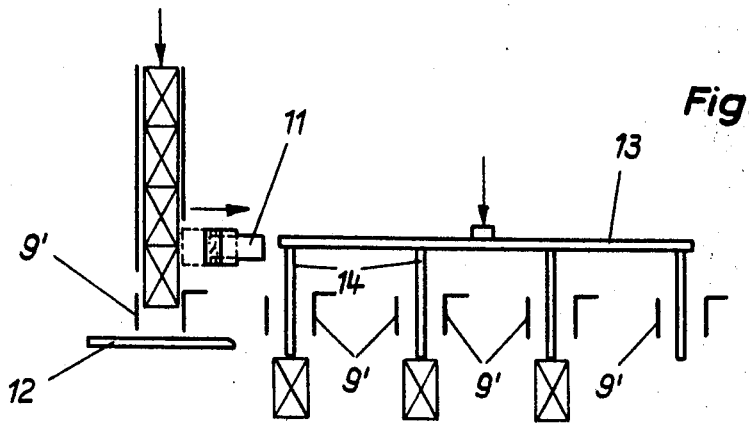

Distribution head 4 comprises a chain 9 with chocolate pick-up members or yokes 9′ driven by a shaft 10 (FIGS. 3–5). The yokes 9′ successively come to face the end of the column of chocolates 2 of waiting line 5 to each receive or take-up a chocolate 2 stopped by an abutment 12 mounted on an oscillating arm 12′. A member for holding the end of the column of chocolates 2, formed by a lateral block 11 mounted on another oscillating arm 11′, jams the next-to-last chocolate 2 so that the column of chocolates can no longer advance. The abutment 12 then moves forward by about 3mm (FIG. 7) to separate the chocolate 2 in yoke 9′ from the chocolate jammed by block 11. The chain 9 then moves forward by one step and a further empty yoke 9′ comes to face the end of the column of chocolates 2. The block 11 disengages from the jammed chocolate and the column moves forward by the length of one chocolate. This cycle is repeated until the desired number of chocolates 2 (three in the described example) are located in the yokes 9′ of the chain. The oscillating arms 11′ and 12′ are controlled by cams (not shown) driven by the shaft of the motor of the distribution head.

An extractor 13 provided with tubular push-pieces 14 forming blow-pipes is mounted on the distribution head 4 for a reciprocating movement whereby, when the chain 9 is stopped, the push-pieces 14 facing yokes 9′ move the chocolates 2 out of these yokes 9′. The reciprocating movement of extractor 13 is obtained by a mechanism of known type (not shown) driven from the driving shaft of head 4. The push-pieces 14 are arranged to simultaneously blow air under pressure against the chocolates to move them along the delivery channels 6, 7 and 8, of which only channel 6 is shown in FIG. 2.

Each of these channels, for example 6, is closed by a cover 15. At the end of channel 6 is a mobile flap 16 schematically shown in FIG. 2. Each chocolate 2 moves along a path of different length depending upon the place it must occupy in tray 1, channel 6 being longer than channel 7 which in turn is longer than channel 8.

At the end of channel 6 is mounted a pick-up member 17 in the form of a suction cup which sucks the chocolate held by flap 16 and places it in the tray 1 at the desired location. Movement of member 17 is solely vertical. During operation, suction of the cup is cut off as soon as the chocolate is in place in tray 1 and the pick-up member 17 moves up, whereupon flap 16 moves back into place. Movement of member 17 is controlled mechanically from the driving shaft of conveyor P carrying trays 1. For each distribution station (A, B) the chassis of conveyor P has a coupling for driving the corresponding head 4, schematically shown by a chain 18 (FIG. 2), as well as a device for controlling the pick-up members 17, designated generally as 19. The pneumatic controls have not been shown as they do not form part of the invention. This control device 19 comprises a cam 20 driven by a chain 21 from a driving unit (motor-clutch-brake) not shown, mounted at the center of conveyor P. A crank lever 22 is connected by a rod 23 to a slide 24 carrying a rod 25 at the upper end of which is a jib 26 on which pick-up member 17 is mounted. The position of member 17 along the jib can be adjusted according to the location at which it must deliver chocolates 2 into trays 1.

In the described machine, the head 4 must be perfectly synchronized with conveyor P. To this end, it is driven directly by chain 18.

Also, the waiting line 5 enables synchronization of the supplying part (not shown) with the distribution head. Two photo-electric cells are mounted on line 5, a "maxi" cell at 27 to switch off the supply, and a "mini" cell at 28 to control locking of block 11, these cells operating only in case supply of the column of chocolates 2 is insufficient or if it is necessary to stop the column.

For automatic operation, the described installation is started up as follows:

All of the stations (A, B . . .) must be filled, as well as the columns of chocolates up to block 11. Once this is done, conveyor P is started up and loaded with trays 1 from a magazine, not shown. For each individual station, a feeler is provided on the conveyor to give a signal which unlocks block 11 so that no chocolate can be delivered to an empty space. As the chocolates of various sorts are placed simultaneously in the empty trays, at the beginning of operation the incompletely filled trays have to be eliminated.

The described machine has the advantage that there is a perfect synchronization between the different parts of the machine by means of a mechanical connection between these parts and the members controlling them, formed by a kinematic chain with "desmodronic" liason, i.e. a positive or direct liason by mechanical means.

Instead of pneumatic means to drive the chocolates along the conveying channels, of course mechanical means such as a conveyor belt or chain could be used.

What is claimed is:

1. A machine for filling container units with different articles, in which articles of one type are delivered to an article distribution head in a column along a waiting line from a loading conveyor and from said head to one of several distribution stations provided for the various types of articles, in which said distribution head comprises members mounted on a chain to successively come to face the column of articles in the waiting line to receive one article each time, means for holding the end of the column when an article has been taken up by a member, a mobile stop to retain said article in the member and separate it from the column, an extractor for removing articles from the members, channels for conveying the extracted articles towards the corresponding distribution station, means actuated by the extractor for moving the articles along said channels up to said distribution station, means for picking-up articles at the exit end of said channels and lowering the articles directly into the corresponding container unit, and a conveyor for conveying the container units below the distribution stations, and comprising a directly-linked kinematic chain of members providing a synchronized drive of said chain, said holding means, said mobile stop, said extractor, said pick-up means and said container-unit conveyor;

said means for picking-up and lowering articles directly into the corresponding container unit comprising a number of pick-up members equal to the number of places to be filled in the container unit, each pick-up member including means for suction-holding an article, said suction-holding means mounted on a jib which is movable vertically by a cam driven from the driving shaft of said container-unit conveyor, a direct liason being provided between the driving unit of said conveyor and the distribution head;

and said means for holding the end of the column of articles of the waiting line comprising a lateral block arranged to jam the next-to-last article against a wall of said line.

2. A machine according to claim 1, in which said extractor for removing articles from said members comprises tubular push-pieces forming blow pipes, said push-pieces being mounted on a support reciprocated by a mechanism driven from the driving shaft of the distribution head.

* * * * *

UNITED STATES PATENT AND TRADEMARK OFFICE

CERTIFICATE OF CORRECTION

PATENT NO. : 3,977,160

DATED : August 31, 1976

INVENTOR(S) : Telesforo KLUG et al

It is certified that error appears in the above-identified patent and that said Letters Patent are hereby corrected as shown below:

SAPAL (The Assignee) is a corporation of --SWITZERLAND-- and not France as indicated on the patent.

Signed and Sealed this

Eleventh Day of January 1977

[SEAL]

*Attest:*

RUTH C. MASON
*Attesting Officer*

C. MARSHALL DANN
*Commissioner of Patents and Trademarks*